US008225859B1

(12) United States Patent
Moidel et al.

(10) Patent No.: US 8,225,859 B1
(45) Date of Patent: Jul. 24, 2012

(54) DEBRIS CLEANUP TOOL WITH FLOW RECONFIGURATION FEATURE

(75) Inventors: Joe P. Moidel, Houma, LA (US); Lee Brousasard, Youngsville, LA (US); Gerald P. Comeaux, Tomball, TX (US); Ronald E. Burger, Pearland, TX (US); Ronald A. Moore, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/041,099

(22) Filed: Mar. 4, 2011

(51) Int. Cl.
*E21B 31/06* (2006.01)

(52) U.S. Cl. ..... 166/99; 166/105.1; 166/169; 166/205; 166/312; 166/318

(58) Field of Classification Search ..... 166/99, 166/105.1, 169, 205, 312, 318
See application file for complete search history.

(56) References Cited

U.S. PATENT DOCUMENTS

| | | | | |
|---|---|---|---|---|
| 2,327,051 | A | 8/1943 | Lyons et al. | |
| 2,915,127 | A | 12/1959 | O'Farrel | |
| 3,066,735 | A | 12/1962 | Zingg | |
| 3,382,925 | A | 5/1968 | Jennings | |
| 4,031,957 | A | 6/1977 | Sanford | |
| 4,088,191 | A | 5/1978 | Hutchison | |
| 4,276,931 | A | 7/1981 | Murray | |
| 4,296,822 | A | 10/1981 | Ormsby | |
| 4,499,951 | A | 2/1985 | Vann | |
| 4,541,486 | A | 9/1985 | Wetzel et al. | |
| 4,709,760 | A | 12/1987 | Crist et al. | |
| 4,796,704 | A | 1/1989 | Forrest et al. | |
| 5,533,571 | A | 7/1996 | Surjaatmadua et al. | |
| 6,065,451 | A | 5/2000 | Lebrun | |
| 6,102,060 | A | 8/2000 | Howlett et al. | |
| 6,173,795 | B1 * | 1/2001 | McGarian et al. | 175/231 |
| 6,176,311 | B1 | 1/2001 | Ryan | |
| 6,189,617 | B1 | 2/2001 | Sorhus et al. | |
| 6,276,452 | B1 * | 8/2001 | Davis et al. | 166/298 |
| 6,341,653 | B1 | 1/2002 | Firmaniuk et al. | |
| 6,401,822 | B1 | 6/2002 | Baugh | |
| 7,383,881 | B2 | 6/2008 | Telfer | |
| 7,431,091 | B2 | 10/2008 | Themig et al. | |
| 7,434,625 | B2 | 10/2008 | Adams | |
| 7,628,213 | B2 * | 12/2009 | Telfer | 166/381 |
| 7,789,154 | B2 | 9/2010 | Davis | |
| 2007/0272404 | A1 | 11/2007 | Lynde et al. | |
| 2009/0200012 | A1 | 8/2009 | Davis et al. | |
| 2010/0282472 | A1 * | 11/2010 | Anderson | 166/317 |
| 2010/0288485 | A1 | 11/2010 | Blair | |

FOREIGN PATENT DOCUMENTS

| | | | |
|---|---|---|---|
| WO | 2006123109 | A1 | 11/2006 |

* cited by examiner

*Primary Examiner* — Jennifer H Gay
*Assistant Examiner* — Tamatane Aga
(74) *Attorney, Agent, or Firm* — Steve Rosenblatt

(57) ABSTRACT

A debris cleanup tool uses a movable eductor to reconfigure the flow scheme through the tool. During the debris pickup mode, pressurized fluid is delivered to through the tubing to the eductor inlet. The outlet of the eductor is into the surrounding annulus where the flow splits with most going to the surface and the rest down and into a mill making cuttings. The flow into the mill takes the cuttings to a collection volume and then screens the internal flow stream before directing it into the eductor inlet. The eductor body can be repositioned to close the eductor outlet to the annulus and open the outlet into the housing to allow reverse flow. In one embodiment a ball is dropped and pressure is built to break a shear pin to shift the eductor body and to open a bypass around the ball.

18 Claims, 3 Drawing Sheets

DEBRIS CLEANUP TOOL WITH FLOW RECONFIGURATION FEATURE

FIELD OF THE INVENTION

The field of the invention is subterranean borehole cleanup tools and more particularly a debris retention tool that can function in a first configuration for flowing debris into the tool for capture and that can be reconfigured while at the subterranean location to a different flow scheme for another purpose after debris removal ends.

BACKGROUND OF THE INVENTION

Debris cleanup tools that deliver pressurized fluid down a tubing string into an eductor device are illustrated in U.S. Pat. Nos. 6,276,452 and 7,789,154. The eductor exhaust is into the surrounding annulus where the flow splits. Some of the flow goes downhole to a mill that creates the cuttings and that flow enters the mill and takes the cuttings into a debris collection housing. The large cuttings are stopped by a screen and settle out in a debris retention space. The remaining flow with some small debris that passes the screen is sucked into the eductor inlet. The eductor outlet flow that does not travel down the annular space around the tool goes up to the surface in that same annular space. The eductor is installed as a bushing that is fixed in the housing of the debris collection device.

Once such devices were installed in a string and run into the well, they provided the above described flow pattern but had no facility to alter the flow pattern for another purpose. It was determined to be desirable to convert the flow scheme of the tool as described above to be able to flow through the tubing as before as well as to be able to shut off the eductor outlet and direct pressure through the debris collector body and out a lower end through the mill. Being able to do this is advantageous for the reason that the tool can be flowed internally in a reverse direction to the normal up flow from the mill and up to the eductor. In the event the tool gets obstructed this is a good way to get it cleared. An option to revert back to the original flow scheme can also be incorporated so that debris removal can take place after a blockage is removed. In a preferred embodiment the eductor is axially shifted to change the flow scheme through it. This can be configured as a onetime movement or cycling back and forth between the end positions is possible. Those skilled in the art will better appreciate more aspects of the invention from a review of the description of the preferred embodiment and the associated drawings while recognizing that the full scope of the invention is to be determined by the appended claims.

Older debris collection devices such as U.S. Pat. No. 4,276,931 used a complex valve arrangement where flow through the valve actuated it to move axially and such axial movement compressed a rubber ring to seal off a central passage and at the same time open a lateral port into an internal annulus that led to an eductor. Separate flow passages were used for normal reverse flow into the mill to collet debris on pivoting fingers as opposed to flow straight through the valve member for circulation flow through the mill such as when running in to agitate the debris already in the wellbore and to facilitate rapid running in.

SUMMARY OF THE INVENTION

A debris cleanup tool uses a movable eductor to reconfigure the flow scheme through the tool. During the debris pickup mode, pressurized fluid is delivered to through the tubing to the eductor inlet. The outlet of the eductor is into the surrounding annulus where the flow splits with most going to the surface and the rest down and into a mill making cuttings. The flow into the mill takes the cuttings to a collection volume and then screens the internal flow stream before directing it into the eductor inlet. The eductor body can be repositioned to close the eductor outlet to the annulus and open the outlet into the housing to allow reverse flow. In one embodiment a ball is dropped and pressure is built to break a shear pin to shift the eductor body and to open a bypass around the ball. The ball seat can be above or below the eductor outlet.

DETAILED DESCRIPTION OF THE PREFERRED EMBODIMENT

Figure 1:
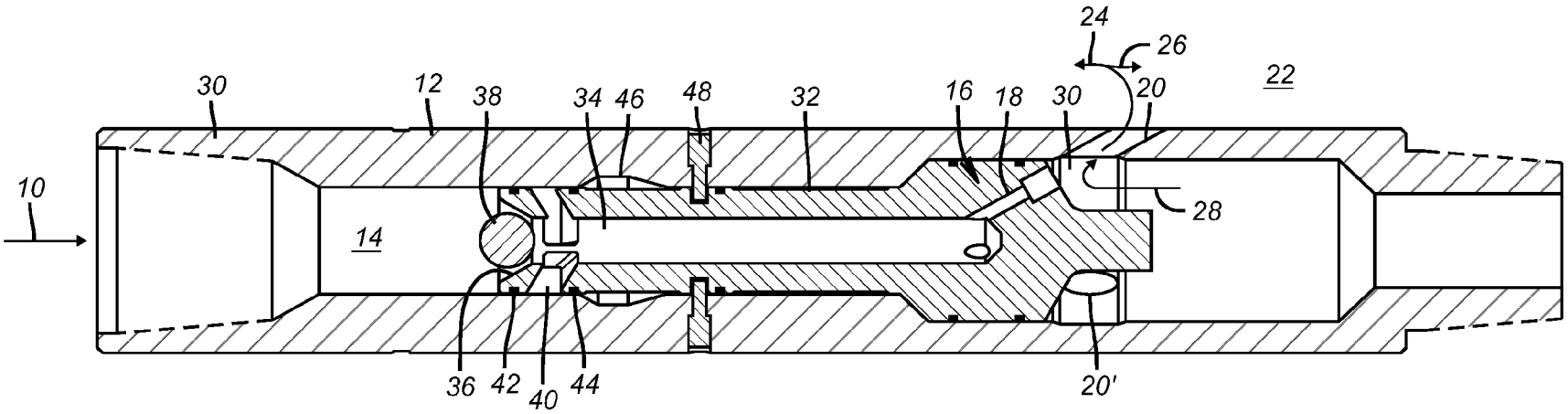
FIG. 1 is a section view through the eductor in the normal flow mode for collecting debris in an embodiment where the seat is above the eductor outlet.
Figure 2:
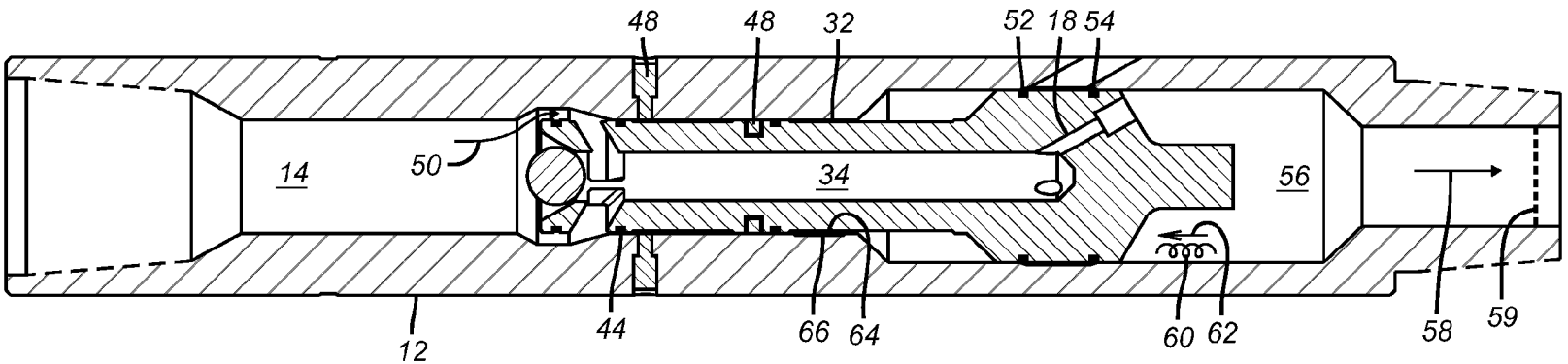
FIG. 2 is the view of FIG. 1 with the eductor body shifted to flow through the housing while shutting off the annulus exit port.

The basic tool is illustrated in U.S. Pat. Nos. 6,276,452 and 7,789,154 which are incorporated here as if fully set forth. The invention focuses on the eductor or the "jet bushing" as it is referred to in U.S. Pat. No. 7,789,154 as items 14 or 40. Both of these bushings show the single flow mode of operation and the present invention adds a feature to convert the flow mode to another mode as will be described using FIGS. 1 and 2, FIG. 1 represents the debris collection flow mode where pressurized fluid represented by arrow 10 enters the housing 12 and passes through passage 14 to the eductor 16 at inlet 18. (It should be noted that 18 is in fact the inlet stream that draws fluid into gap 30 but at the same time with respect to the eductor housing 32, item 18 represents one or more eductor body outlets.) The outlet 20 of the eductor 16 leads to the surrounding annulus 22. The exiting flow through the outlet 20 diverges with most going to the surface as represented by arrow 24 and the rest moving downhole to a mill (not shown) that is cutting a tool (not shown) and generating cuttings. The flow represented by arrow 26 enters the housing 12 at a lower end through the unshown mill. The flow with cuttings goes up a tube into a larger flow area where the larger solids drop out and are collected in an annular space around the inlet tube. The flow with any smaller cuttings continues moving up through a screen 59 and then is sucked in at an inlet as represented by arrow 28. Fluid flow from inlet 18 across gap 30 creates a reduced pressure zone to draw in the flow represented by arrow 28. This flow regime is maintained until the milling ends and the desired debris has been captured. The housing 12 is moved as the mill advances using a string (not shown) connected at thread 30, which is the first end connection for the housing 12. While a single inlet 18 is shown, those skilled in the art will appreciate that there are multiple inlets 18 that are circumferentially spaced as can be seen by the illustration of another outlet 20' in FIG. 1.

The modifications to the prior jet bushing over the prior designs described above are in the internal configuration of the eductor 16 and its ability to move. In FIG. 1 the eductor 16 has a body 32 and an inlet passage 34 that communicates with passage 14. A ball seat 36 is near a top end of the passage 34 and can selectively be used with a ball 38 to allow pressure buildup on the ball 38 using pressure in passage 34. Ball bypass passages 40 extend generally radially through the body 32 and are straddled by seals 42 and 44. Housing 12 has an enlarged portion 46 to allow seal 42 to be bypassed when the eductor body 32 shifts due to pressure on seated ball 38 on seat 36 which initially breaks the shear pin 48. Seal 44 is still against the body 12 in the FIG. 2 position. The flow is down passage 14 and around seal 42 that is now aligned with enlarged portion 46 and as further represented by arrow 50. From there seal 44 forces the flow into the ball bypass 40 and into passage 34.

At the other end, the eductor inlet 18 has shifted away from a spaced alignment with the outlet 20 in housing 12 and now seals 52 and 54 close off all the ports 20 to the surrounding annulus 22. Instead, the eductor inlet 18 is now an open conduit into chamber 56 and can direct flow down to the mill (not shown) as schematically represented by arrow 58. Flow can now be reversed through the debris collection tool to back flush the internal screen or to unclog the mill if it gets fouled with cuttings. Circulation can also be established as the housing 12 and the associated equipment are removed from the wellbore.

Figure 1A:
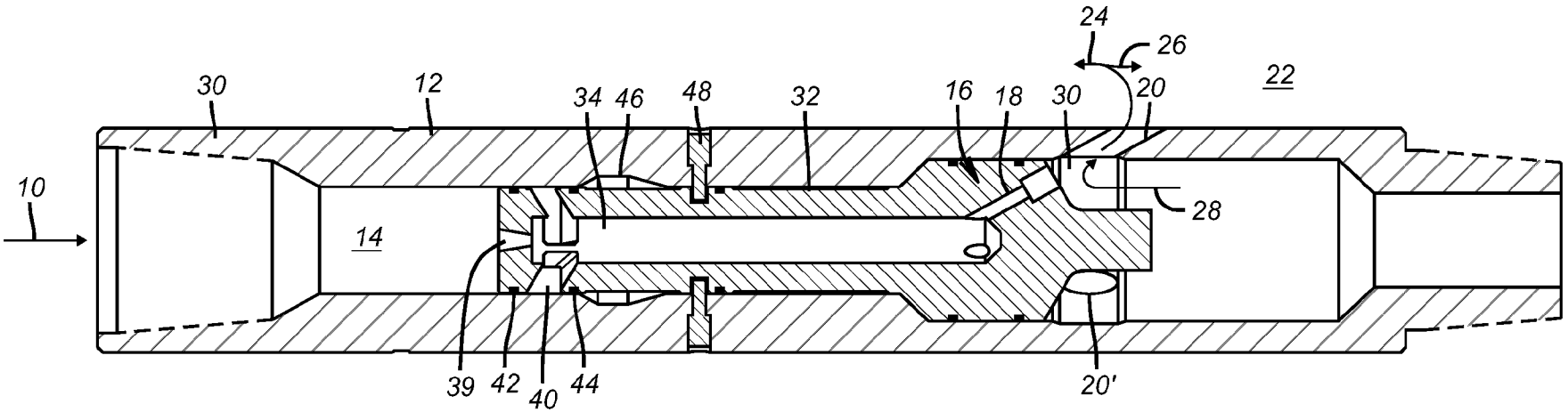
FIG. 1*a* is an alternative embodiment to FIG. 1 using flow through a restriction to reconfigure the tool.
Figure 2A:
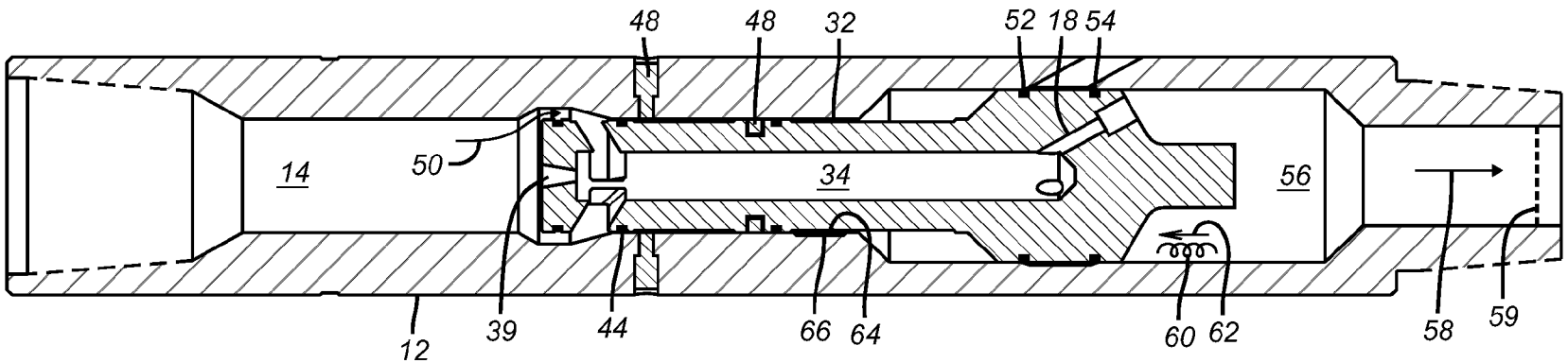
FIG. 2*a* is the view of FIG. 1*a* in the shifted position.

For the one time shifting embodiment of FIGS. 1 and 2 an alternative to dropping a ball 38 on the seat 36 and pressuring up to shift body 32 and bypass the ball 38 using the enlarged portion 46 to bypass seated ball 38 through bypass 40 can alternatively be done using developed pressure or flow in passage 34 such as by proper sizing of the passage or with a flow restrictor 39 (see FIGS. 1*a* and 2*a*) that develops enough force induced by pressure drop to break the shear pin 48 and cause shifting from the FIG. 1 to the FIG. 2 positions. Another alternative to having the bypass 40 and the associated enlarged portion 46 is to drop the ball 38 and pressure up to cause the shift followed by reversing flow from the surface down the annulus 22 to flow the ball 38 back up to the surface before again switching to circulation mode with the body 32 still in the FIG. 2 position and the ball 38 no longer there.

Another option for the embodiment in FIGS. 1 and 2 is to lock in the movement in the FIG. 2 position to prevent a return to the debris collection mode of FIG. 1. This can be done with body ratchet or lock rings or snap rings that jump into a surrounding groove or using some kind of bias that pushes in the general direction of arrow 58 any one of which will hold the FIG. 2 position once the shear pin or pins 48 are broken. Although shear pins are illustrated other selectively retaining members such as shear rings, for example, can be used in singular or multiple quantities. Arrow 58 is shown at a location that is a second end connection for the housing 12.

Another option is to be able to switch back and forth between the flow modes of FIGS. 1 and 2. This can be done using the illustrated design in FIGS. 1 and 2 with a few schematically illustrated differences. Spring or other bias device such as a pressurized chamber with compressible fluid 60 that acts in the direction of arrow 62 can be used with a schematically illustrated j-slot mechanism 64 and 66 with the pin being on either the housing 12 or the body 32 and the track the pin rides in can be on the other member. The use of ball 38 on seat 36 is optional and another alternative can be just using the passage 34 to create enough backpressure to overcome the spring 60 and move the j-slot mechanism relatively so that the pin 64 lands in a slot of a different height on the completion of a pressure removal and application cycle. The body 32 will then alternatively wind up in the FIG. 1 or FIG. 2 positions with each complete pressure cycle. Other options are available such as requiring a predetermined number of pressure removal and application cycles before a change from the debris collection mode of FIG. 1 to the flow through mode of FIG. 2.

Figure 3:
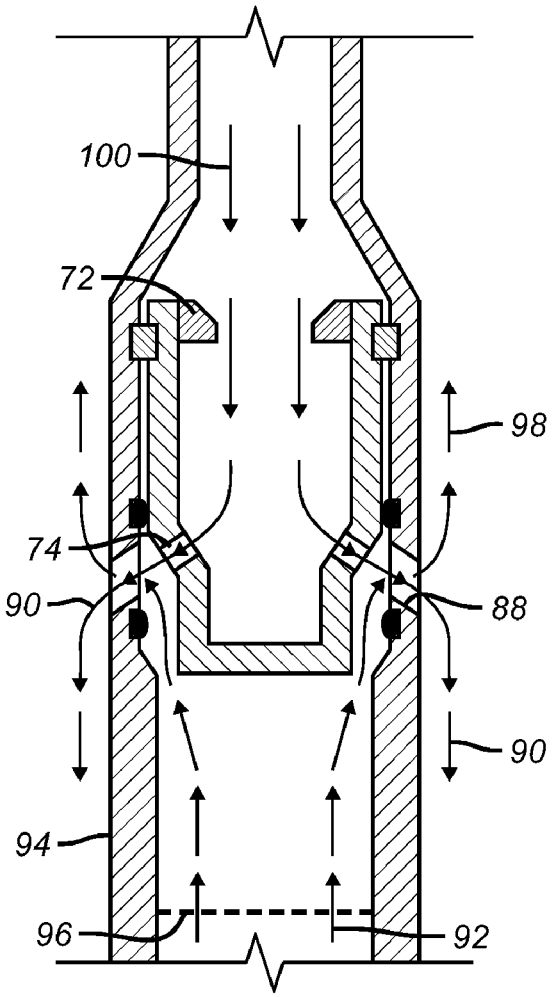
FIG. 3 is an alternative embodiment to FIG. 1 where the seat is above the eductor outlet shown in the normal flow mode for collecting debris.
Figure 4:
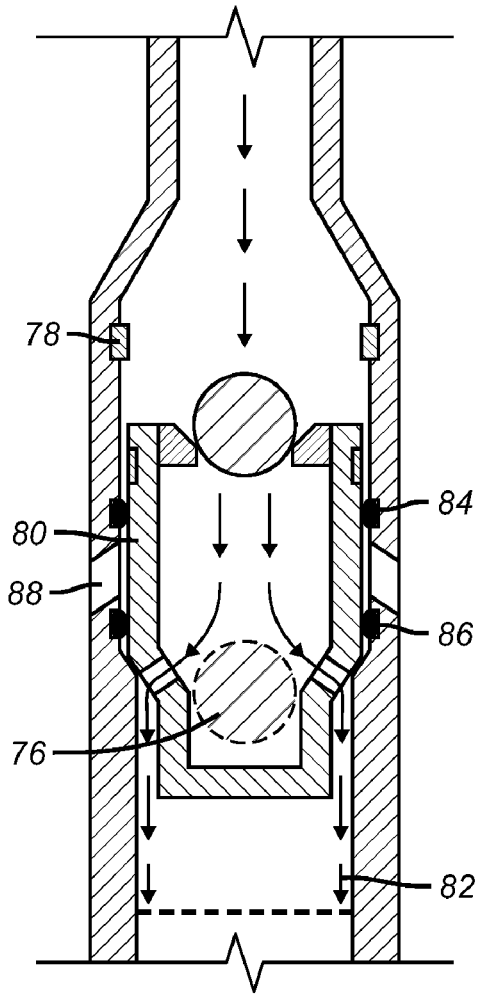
FIG. 4 is the view of FIG. 3 with the eductor body shifted to flow through the housing while shutting off the annulus exit port.

FIGS. 3 and 4 illustrate an alternative embodiment to FIGS. 1 and 2 where the principle of operation is the same with the ball seat 72 above eductor outlet 74. The ball or other object 76 is shown in several positions on the seat 72 and blown through the seat 72 after eductor body 80 shifts. Pressure buildup breaks the sheared connection 78 and the eductor body 80 moves down so that flow is shifted to the pattern of arrows 82. Seals 84 and 86 close off ports 88 using the eductor body 80. Ball 76 moved past the seat 72 and is retained by the eductor body 80. Arrows 90 in FIG. 3 show the normal flow from the surface as it emerges through the eductor. Arrows 92 show the returning flow through a mill (not shown) after debris has settled and collected in housing 94 and passed through schematically illustrated screen 96. The exiting flow through ports 88 in FIG. 3 splits with arrows 98 representing return flow to the surface and arrows 100 representing supply flow from the surface into the top of the housing 94. The same operational variations described with regard to FIGS. 1 and 2 are available for the embodiment of FIGS. 3 and 4.

The above description is illustrative of the preferred embodiment and many modifications may be made by those skilled in the art without departing from the invention whose scope is to be determined from the literal and equivalent scope of the claims below.

We claim:

1. A debris collection apparatus, comprising:

a housing having a passage therethrough with opposed end connections and at least one lateral opening, a first of said end connections adapted to receive pressurized fluid and a second end connection adapted to support a mill;

an eductor body movably mounted in said housing between a debris collection position and a flow through position, said body having an eductor body inlet in flow communication with said first end connection of said housing passage and at least one eductor body outlet;

said eductor body outlet aligned with said lateral opening in said housing in said debris collection position and, in said flow through position, said eductor body outlet is open to said passage for flow toward said second end with said eductor body blocking said lateral opening;

said eductor, in said debris collection position, drawing fluid from said second end connection while debris is retained in said housing.

2. The apparatus of claim 1, wherein:

said eductor body is moved with pressure applied to an object temporarily obstructing said eductor body inlet.

3. The apparatus of claim 2, wherein:

said eductor body further comprises a bypass passage around said object that opens upon movement of said eductor body between said debris collection position and said flow through position.

4. The apparatus of claim 2, wherein:

said object is removed with said eductor body in said flow through position with flow entering said second end connection of said housing.

5. The apparatus of claim 1, wherein:

said eductor body is moved with flow through said eductor body generating a force on said eductor body.

6. The apparatus of claim 5, wherein:

said force breaks a breakable member selectively retaining said eductor body to said housing.

7. The apparatus of claim 1, wherein:

said eductor body is movable in opposed directions between said debris collection position and said flow through position at least once.

8. The apparatus of claim 5, wherein:

said force overcomes a bias on said eductor body acting in an opposed direction to said force.

9. The apparatus of claim 5, wherein:

said eductor body movable between said debris collection and flow through position with cycling of flow through said eductor body.

10. The apparatus of claim 5, wherein:

said inlet and outlet of said eductor body are open for flow in both debris collection and flow through positions.

11. The apparatus of claim 9, wherein:

said movement of said eductor body in said housing is controlled by a j-slot mechanism.

12. The apparatus of claim 1, wherein:

said eductor body outlet is spaced apart from said lateral opening in said housing in said debris collection position of said eductor body.

13. The apparatus of claim 1, wherein:

said eductor body outlet further comprises spaced peripheral seals that straddle said lateral outlet of said housing in said flow through position of said eductor body.

14. The apparatus of claim 3, wherein:

said eductor body comprises spaced seals that straddle said bypass passage to close said bypass passage against said housing in said debris collection position of said eductor body.

15. The apparatus of claim 14, wherein:

one of said spaced seals is aligned with said bypass passage to allow flow around said object when said eductor body is in said flow through position.

16. The apparatus of claim 1, wherein:

said passage further comprises a screen between said eductor body and said second end connection on said housing, said screen having a lower face closer toward said second end connection;

whereupon with said eductor body in said flow through position debris on said lower face can be displaced off said screen.

17. The apparatus of claim 1, wherein:

said outlet on said eductor body comprises a plurality of outlets aligned with a plurality of lateral openings in said housing in said debris collection position of said eductor body.

18. The apparatus of claim 2, wherein:

said object lands on a seat in said eductor body allowing applied pressure to shift said eductor body to said flow through position.

* * * * *